US007314050B2

(12) United States Patent
Hartstock et al.

(10) Patent No.: US 7,314,050 B2
(45) Date of Patent: Jan. 1, 2008

(54) MASCARA BRUSH

(75) Inventors: Karl Hartstock, Ansbach (DE); Omar Rizk, Weidenbach (DE)

(73) Assignee: Geka Brush GmbH, Bechhofen (DE)

( * ) Notice: Subject to any disclaimer, the term of this patent is extended or adjusted under 35 U.S.C. 154(b) by 0 days.

(21) Appl. No.: 11/242,786

(22) Filed: Oct. 5, 2005

(65) Prior Publication Data

US 2006/0076031 A1 Apr. 13, 2006

(30) Foreign Application Priority Data

Oct. 7, 2004 (EP) ..... 04023872

(51) Int. Cl.
*A45D 40/26* (2006.01)

(52) U.S. Cl. ..... 132/218; 300/21; 15/206

(58) Field of Classification Search ..... 132/218; 300/21; 15/206, 207
See application file for complete search history.

(56) References Cited

U.S. PATENT DOCUMENTS

| | | | | |
|---|---|---|---|---|
| 2,230,968 | A * | 2/1941 | Cave | 300/21 |
| 4,586,520 | A * | 5/1986 | Brittain | 132/218 |
| 5,063,947 | A * | 11/1991 | Gueret | 132/218 |
| 5,165,760 | A * | 11/1992 | Gueret | 300/21 |
| 5,197,497 | A * | 3/1993 | Gueret | 132/218 |
| 5,345,644 | A * | 9/1994 | Gueret | 15/160 |
| 6,237,609 | B1 | 5/2001 | Vasas | |
| 6,260,558 | B1 | 7/2001 | Neuner | |
| 6,279,503 | B1 | 8/2001 | Choi et al. | |
| 6,279,583 | B1 * | 8/2001 | Neuner | 132/218 |
| 6,289,902 | B1 | 9/2001 | Mathiez | |
| 6,314,967 | B1 | 11/2001 | Castells | |
| 6,662,810 | B2 * | 12/2003 | Gueret | 132/218 |
| 2001/0010227 | A1 * | 8/2001 | Dumler | 132/218 |
| 2003/0172485 | A1 | 9/2003 | Dumler et al. | |
| 2004/0226573 | A1 | 11/2004 | Gueret | |

FOREIGN PATENT DOCUMENTS

| | | |
|---|---|---|
| DE | 44 46 521 A1 | 6/1996 |
| DE | 100 03 858 A1 | 8/2001 |
| DE | 102 11 780 A1 | 9/2003 |
| EP | 1 454 561 A1 | 9/2004 |
| WO | WO 03/063642 A2 | 8/2003 |

* cited by examiner

*Primary Examiner*—Todd E. Manahan
(74) *Attorney, Agent, or Firm*—Browdy and Neimark, PLLC

(57) ABSTRACT

In a mascara brush comprising a plurality of bristles which project radially outwards from an oblong core, with the bristles having varying lengths such that a first number of longer bristles, by their tips, form an outer envelope and a second number of shorter bristles, by their tips, form an inner envelope, it is provided, according to the invention with a view to varying application properties being obtained along the bristle trimming, that the envelope of the shorter bristles is conical, double-conical, convex or concave or a combination thereof.

10 Claims, 9 Drawing Sheets

MASCARA BRUSH

FIELD OF THE INVENTION

The invention relates to a mascara brush comprising a plurality of bristles which project radially outwards from an oblong core, with the bristles having varying lengths such that a first number of longer bristles, by their tips, form an outer envelope and a second number of shorter bristles, by their tips, form an inner envelope.

BACKGROUND OF THE INVENTION

Mascara brushes of the generic type are known from DE 100 03 858 A1, DE 44 46 521 A1, DE 102 11 780A1, U.S. Pat. No. 6,289,902, U.S. Pat. No. 6,279,503 and U.S. Pat. No. 6,260,558.

Bristles of varying lengths are provided for several reasons, with a predominant reason residing in that the varying rigidity of the bristles thus obtained can be exploited for excellent properties of transfer of the liquid mascara and of wetting upon application on to the lashes on the one hand and for favorable combing and separating properties on the other. Conventionally, bristles of varying lengths have been put into practice by bristles of varying lengths being supplied in more or less random distribution during the manufacture of the brush prior to the wires being intertwisted, or by the longer bristles being trimmed not only for uniformity, but specifically for the production of a certain outside geometry of bristles of varying lengths in the finished brush, in which way to obtain for example a conical configuration of the entire brush or tip or brushes with impressions on the surface area.

It has also been known to equip intertwisted brushes with bristles of varying rigidity, with the ends of the bristles being ground after manufacture and with the more rigid bristles, during such a grinding job, wearing off and being shortened to a higher degree than the softer bristles.

DE 100 03 858 A1 teaches a mascara brush in which the ends of the longer bristles are located on a surface of a cylinder of greater diameter and the ends of the shorter bristles on a surface of a cylinder of a smaller diameter.

Apart from milling cuts of the outside surface area, the shorter bristles of known brushes either do not possess any defined envelope geometry or they have a cylindrical configuration.

SUMMARY OF THE INVENTION

It is an object of the invention to embody an mascara brush, the shorter bristles of which possess varying application properties as seen in the longitudinal direction of the brush.

According to the invention, this object is attained by the envelope of the shorter bristles being conical, double-conical, convex or concave or a combination of these configurations.

The design according to the invention enables the lashes to be variably accentuated in the middle area, or the outer areas, of the eyelid by varying volumes of mascara being applied.

A brush according to the invention can be produced by injection molding or, conventionally, by the bristles being fixed between intertwisted wire sections.

In intertwisted brushes, corresponding selection of the fibers of the shorter and/or longer bristles can provide for the configuration of the tips to reproduce the helix of the intertwisted wires or for uniform distribution of the tips by the use of, for instance, hollow fibers, cross fibers, so-called EOS fibers or the like.

The tips of the short and long bristles can have the same configuration or differ, being for example conical, truncated or flatly obtuse.

The invention also relates to a method of manufacturing an intertwisted brush, with the bristles first being positioned between the legs of a U-shaped wire that will later be the core and then, proceeding from a flat configuration, being shaped into a helix and fixed by the legs of the U being intertwisted, the method according to the invention excelling by the fact that the bristles, while flat, are pre-fixed between the legs of the U in such a way that shorter ends of bristles are located on one side and longer ends of bristles on the other side of the wire sections, with at least the shorter ends of bristles then being contoured and the legs of the U being intertwisted only afterwards.

Bristles have per se been known to be positioned asymmetrically i.e., by varying lengths, between the wire sections. As compared to this, the novelty of the invention resides in that pre-fixing takes place in such a way that the shorter ends can be contoured whereby, after the job of intertwisting, an envelope originates for the shorter bristles which deviates from a cylindrical configuration, producing varying lengths of the shorter bristles along the brush.

Preferably, the bristles have a Shore hardness A of 5 to 150. They can be cylindrical or conical. Each individual bristle can have an envelope of favorably 0.05 to 0.6 mm, the cross-sectional shape of the bristles within this envelope being circular or non-circular or varying longitudinally.

Details of the invention will become apparent from the ensuing description of preferred exemplary embodiments, taken in conjunction with the drawing.

DESCRIPTION OF THE PREFERRED EMBODIMENTS

Figure 1:
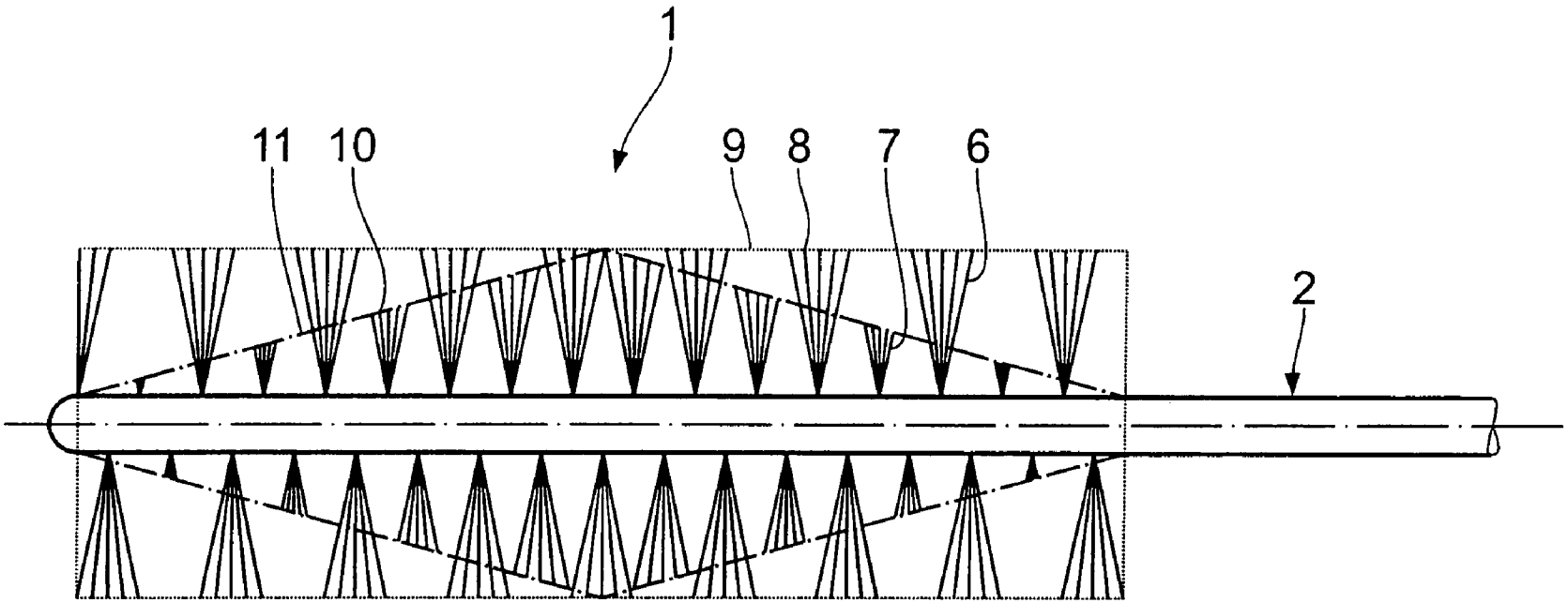
FIG. 1 is a view of a mascara brush with a cylindrical outer envelope and a double-cone inner envelope, with the tips of the cone lying outside.

The mascara brushes 1 seen in the drawing comprise a core 2 in the form of a wire 5 which is bent in the way of a hairpin, with the legs of the U or wire sections 3, 4 thus produced being intertwisted.

Bristles are fixed between the intertwisted wire sections 3, 4 of the wire 5 that is bent in the way of a hairpin, namely longer bristles 6 and shorter bristles 7, which project approximately radially outwards in the form of bunches of bristles.

The tips 8 of the longer bristles 6 constitute an outer envelope 9 and the tipps 10 of the shorter bristles 7 constitute an inner envelope 11.

As seen in FIGS. 1 to 7, the outer envelope 9 and the inner envelope 11 can have totally different configurations of curved or straight, concave or convex definition or mixtures thereof.

Figure 9:
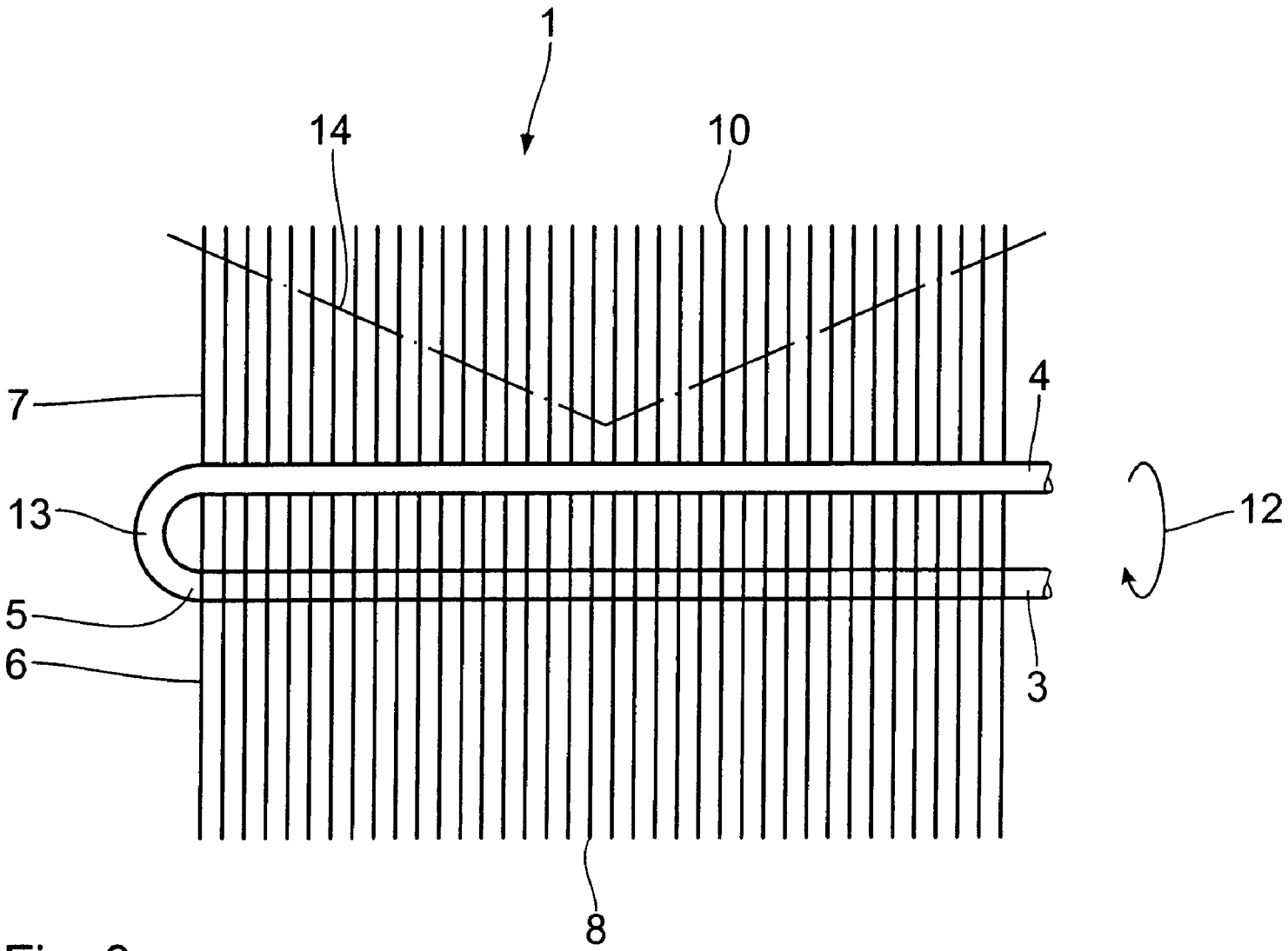
FIG. 9 is a diagrammatic view illustrating the manufacture of a mascara brush according to the invention.

The shaping depends on the special effect that is to be achieved upon application; FIG. 9 illustrates how a mascara brush 1 according to the invention is being produced. In a manner known per se, a wire 5 is bent in the way of a hairpin, forming a U, so that two parallel wire sections 3, 4 result. A plurality of bristles (only few of which being illustrated by way of example) are being asymmetrically inserted in parallel to one another and perpendicularly to the wire sections 3, 4 in such a way that longer bristles 6 project towards one side, downwards in FIG. 9, and shorter bristles 7 project towards the other side, upwards in FIG. 9.

In the exemplary embodiment, after the wire sections 3, 4 have been intertwisted, the ends 8 of the longer bristles or bristle segments, constitute a near cylindrical envelope in the direction of the arrow 12 with the bight of the U 13 fixed; they are cut into the shape of the outer envelope by the known cutting operation of a cutter and counterpart cutter.

Figure 2:
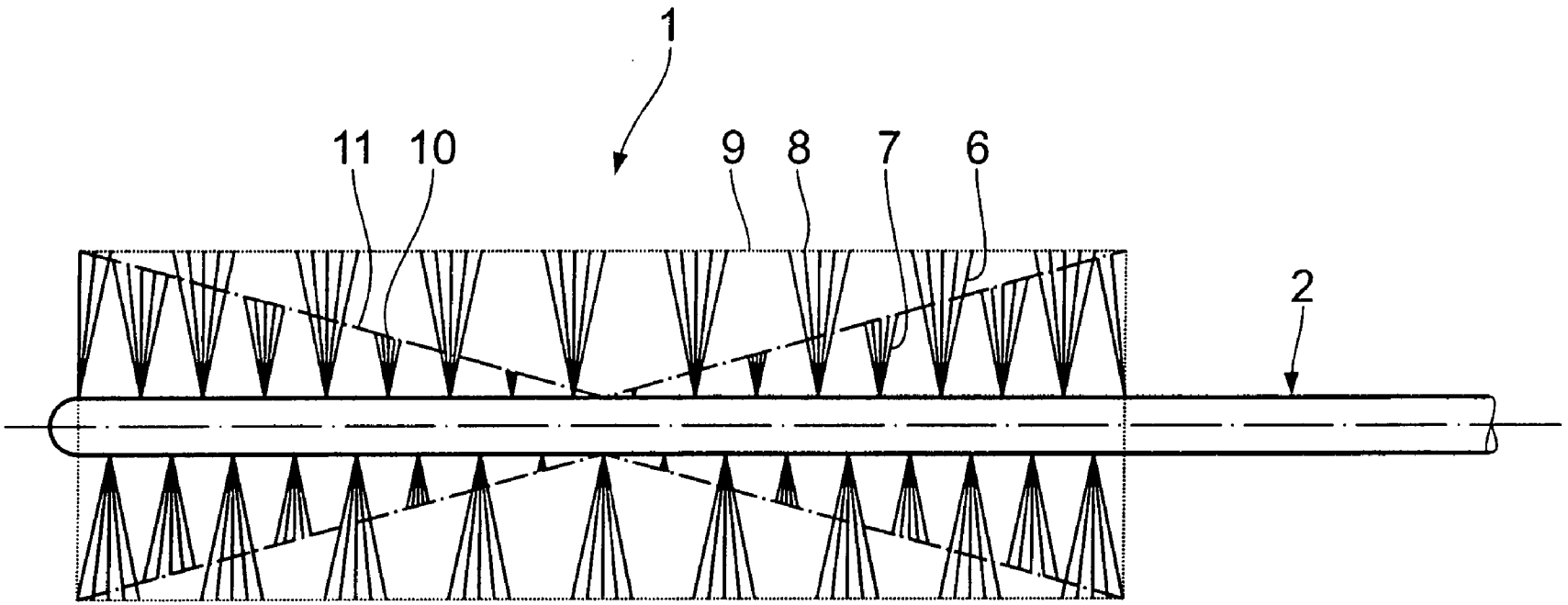
FIG. 2 is a view of a mascara brush with a cylindrical outer envelope and a double-cone inner envelope, with the tips of the cone lying inside.
Figure 3:
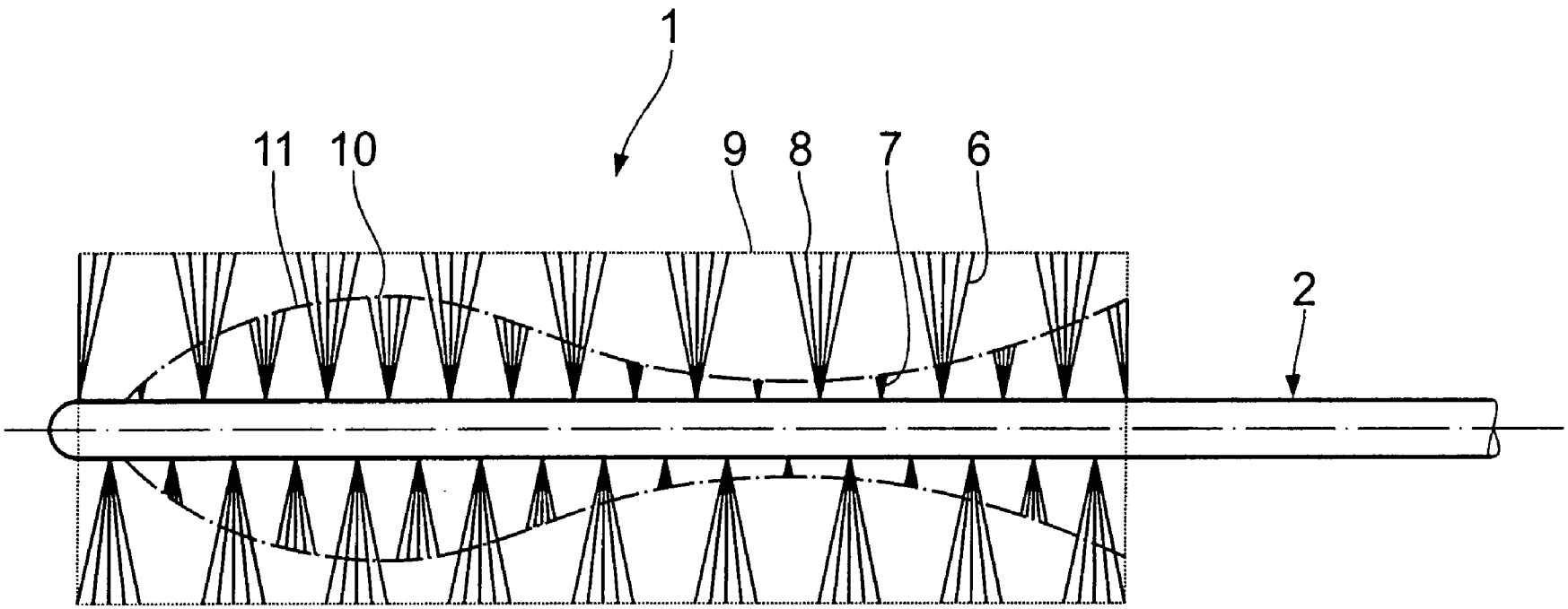
FIG. 3 is a view of a mascara brush with a cylindrical outer envelope and an inner envelope which is convex to the left and concave to the right.
Figure 4:
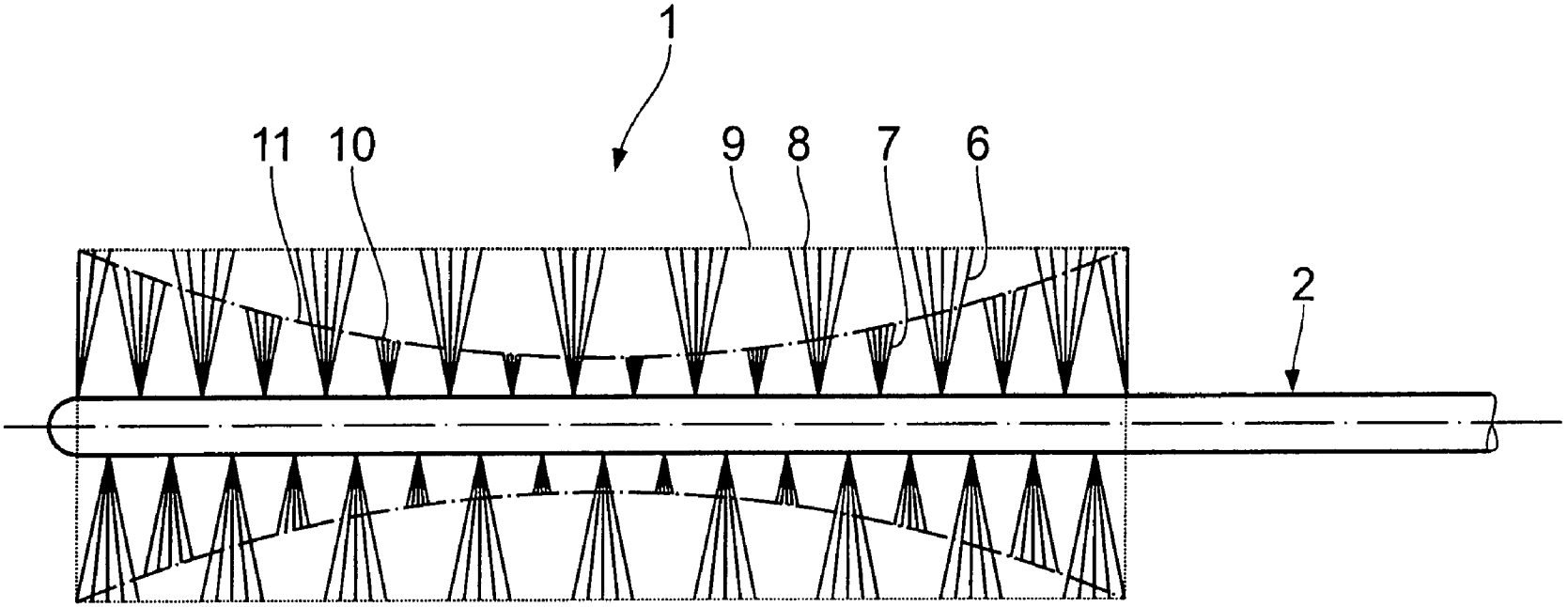
FIG. 4 is a view of a mascara brush with a cylindrical outer envelope and a continuously concave envelope.
Figure 5:
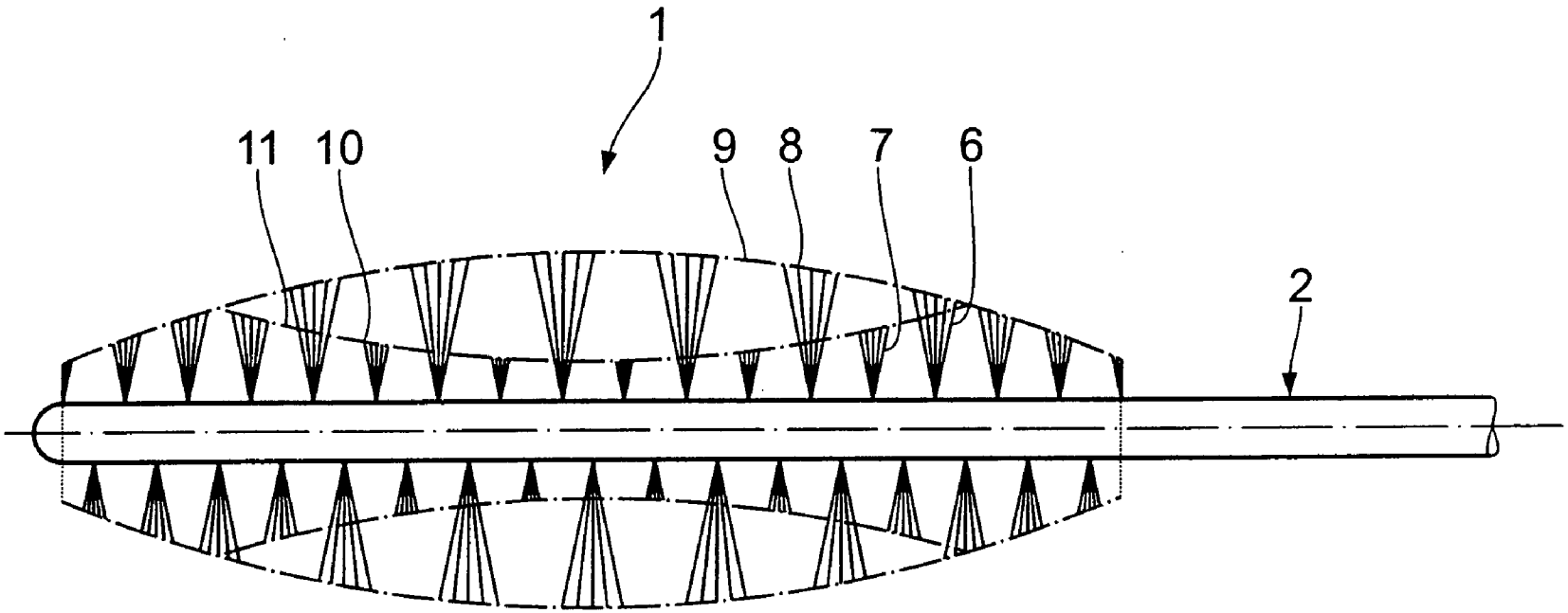
FIG. 5 is a view of a mascara brush with a baseball-type, convexly bulging outer envelope and a continuously concave inner envelope with truncated end zones.
Figure 6:
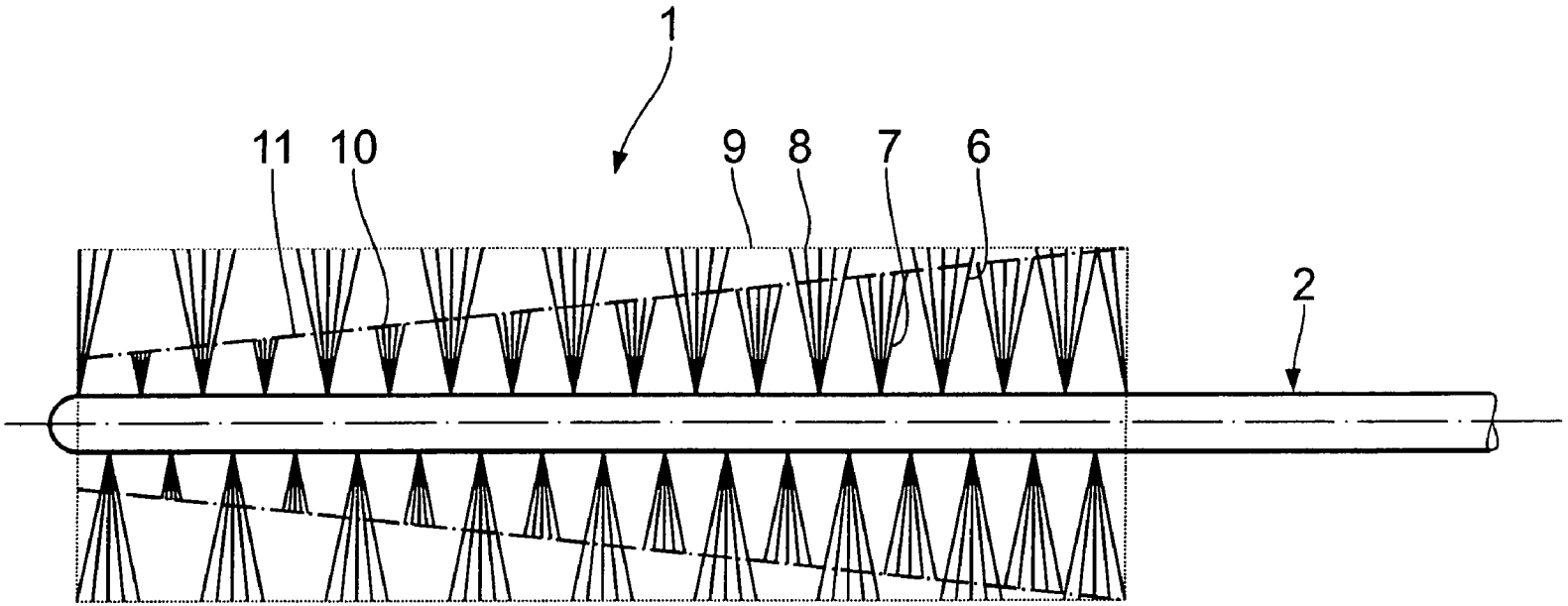
FIG. 6 is a view of a mascara brush with a cylindrical outer envelope and a truncated inner envelope.
Figure 7:
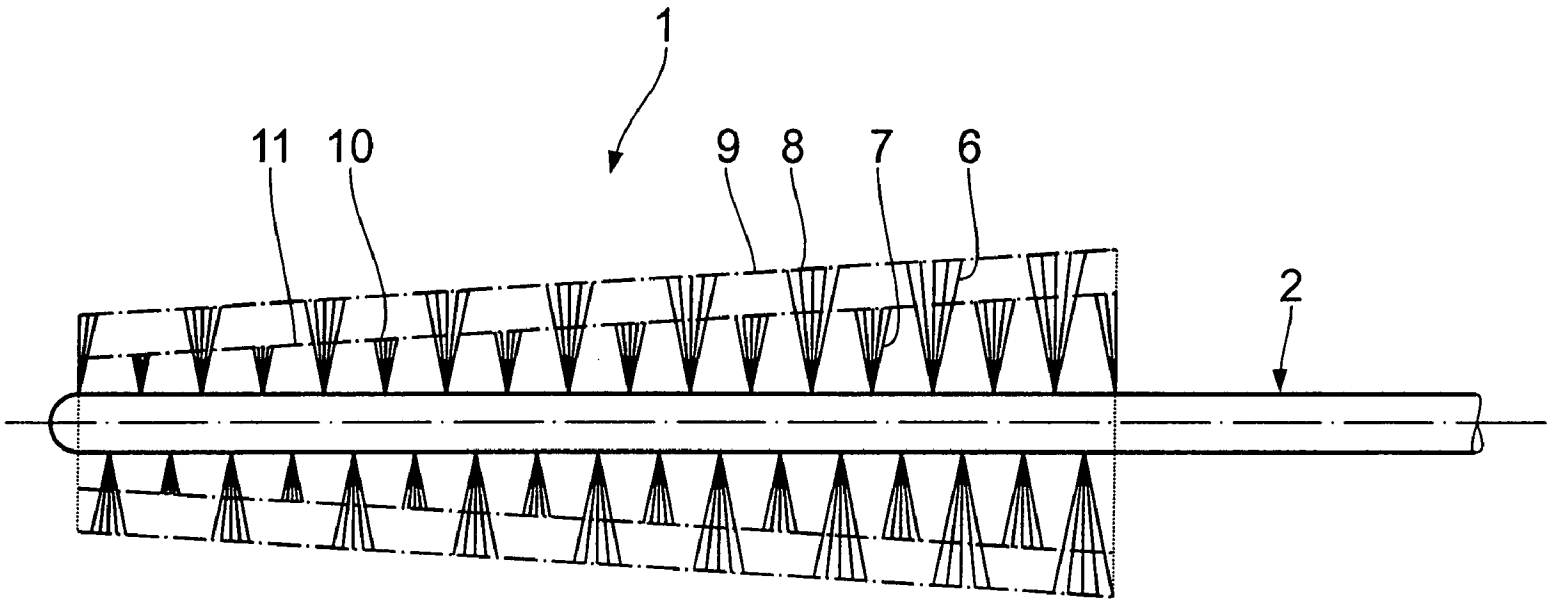
FIG. 7 is a view of a mascara brush with a truncated outer envelope and a corresponding truncated inner envelope.
Figure 8:
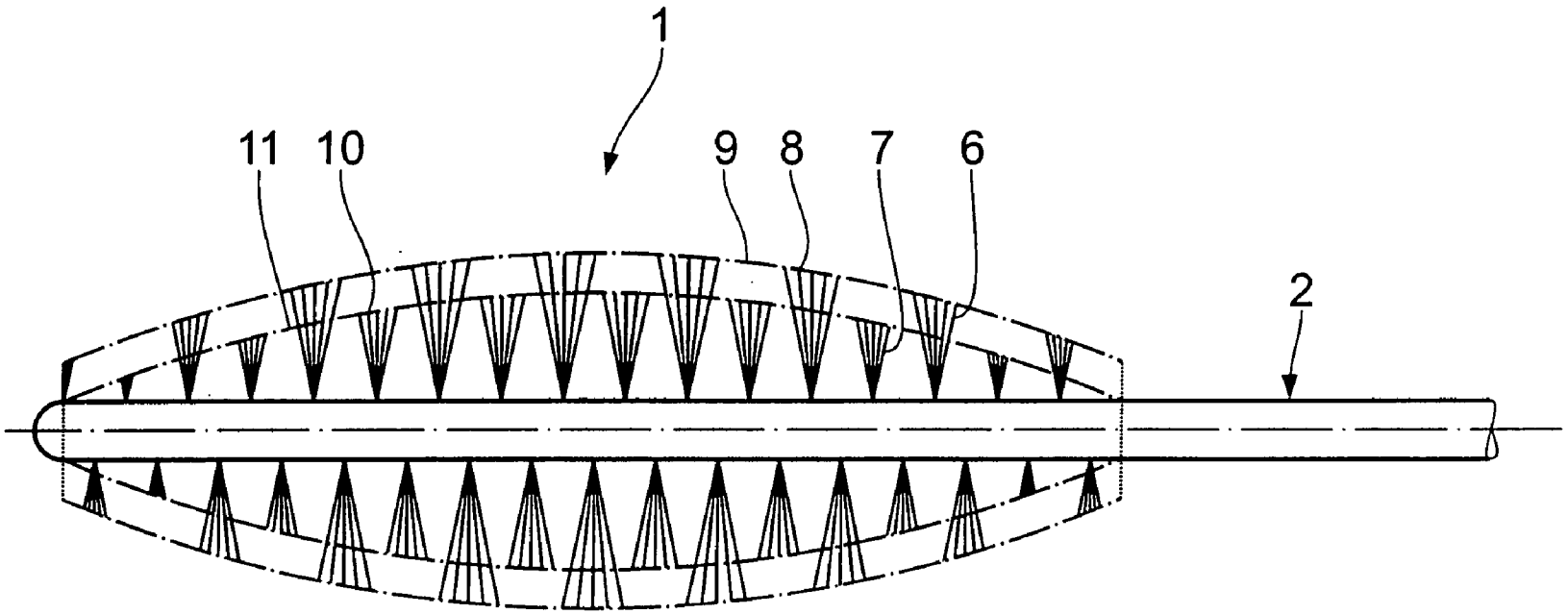
FIG. 8 is a view of a mascara brush with a convex, baseball-type outer envelope and a corresponding inner envelope.

The short bristles or bristle segments 7 are being pre-fixed prior to the job of intertwisting, by the wire sections 3, 4 being pressed one against the other or, respectively, by a holding device being engaged, after which they are being cut into a V-shaped trim line 14, as a result of which, after the intertwisting job, the ends 10 of the shorter bristles 7 are arranged in a double-cone envelope so that a brush is produced as seen in FIG. 2.

What is claimed is:

1. A mascara brush, comprising a plurality of bristles which project radially outwards from an oblong core, with the bristles having varying lengths such that a first number of longer bristles, by their tips, form an outer envelope and a second number of shorter bristles, by their tips, form an inner envelope, wherein the inner envelope (11) of the shorter bristles (7) is concave at least along a part of the length thereof, and wherein the outer envelope of longer bristles is not concave along the length thereof and therefore has a different shape than that of the inner envelope of shorter bristles.

2. A mascara brush according to claim 1, wherein it is produced by one of injection molding and the bristles (6, 7) being fixed between intertwisted wire sections (3, 4).

3. A mascara brush according to claim 1, wherein the tips (8, 10) of at least one of the short and long bristles (6, 7) have one of the same and different configurations, in particular being one of conical, truncated and flatly obtuse.

4. A mascara brush according to claim 1, wherein the bristles (6, 7) have a Shore hardness A of 5 to 150.

5. A mascara brush according to claim 1, wherein the bristles are one of cylindrical and conical as seen in the longitudinal direction.

6. A mascara brush according to claim 1, wherein each individual bristle has an envelope of a diameter of 0.05 to 0.06 mm; and in that the cross-sectional shape of each envelope is one of circular, non-circular and varies longitudinally.

7. A mascara brush according to claim 1, wherein the outer envelope of longer bristles is cylindrical along the length thereof.

8. A mascara brush according to claim 1, wherein the outer envelope of longer bristles is convex along at least part of the length of the intertwisted U.

9. A mascara brush according to claim 1, wherein both the longer bristles and the shorter bristles have the same transverse cross-section over the full length of each of the longer and shorter bristles.

10. A method for the manufacture of a mascara brush having a plurality of bristles which project radially outwards from an oblong core, with the bristles having varying lengths such that a first number of longer bristles, by their tips, form an outer envelope and a second number of shorter bristles, by their tips, form an inner envelope, wherein the inner envelope (11) of the shorter bristles (7) is concave at least along a part of the length thereof, said method comprising the steps of:

positioning the bristles at first between the legs of a wire in the form of a U which later constitutes the core and, proceeding from a flat configuration, being shaped into a helix and fixed by the legs of the U being intertwisted, wherein the bristles, while still flat, are pre-fixed between the legs of the U so that shorter ends of bristles are located on one side of the wire sections and longer ends of bristles on the other side, with at least the shorter ends of the bristles being cut so that the cut ends form a concave trim line along at least part of the length of the U and the legs of the U being intertwisted afterwards so that the cut shorter ends form the concave envelope along at least part of the length of the intertwisted U.

* * * * *